United States Patent [19]

Ibrahim et al.

[11] 4,312,190

[45] Jan. 26, 1982

[54] GLASS DOOR MERCHANDISER WITH HEAT TRAP

[75] Inventors: Fayez F. Ibrahim, Niles; Arthur Perez, Buchanan, both of Mich.

[73] Assignee: Tyler Refrigeration Corporation, Niles, Mich.

[21] Appl. No.: 78,917

[22] Filed: Sep. 26, 1979

[51] Int. Cl.[3] ..... A47F 3/04

[52] U.S. Cl. ..... 62/255; 62/156; 62/405; 62/256

[58] Field of Search ..... 62/255, 256, 409, 430, 62/272, 156, 405

[56] References Cited

U.S. PATENT DOCUMENTS 2,632,303 3/1955 Smith ..... 62/255

2,750,758 6/1956 Hoye et al. ..... 62/255

*Primary Examiner*—Albert J. Makay

*Assistant Examiner*—Henry Bennett

*Attorney, Agent, or Firm*—LeBlanc, Nolan, Shur & Nies

[57] ABSTRACT

A refrigerated glass door merchandiser in which heat generated during a defrost cycle of operation is prevented from flowing into the refrigerated display section. The glass door merchandiser is formed by a cabinet having an access opening in one of its walls with a glass door covering such access opening. The glass door is movable for enabling access through the access opening to products within the display section of the merchandiser. An air conduit extends around the cabinet and has an outlet opening at one end of the access opening and an inlet opening at the other end of the access opening. The outlet and inlet openings are arranged in alignment so that air circulated through the conduit and leaving the outlet opening is directed towards and received by the inlet opening for establishing a continuous air band around the cabinet and across the access opening during a refrigeration cycle of operation. As the air is circulated by a set of fans which are arranged in the air conduit, the air is refrigerated by a set of evaporator coils. During a defrost cycle of operation, both the air flow and the operation of the evaporator coils are temporarily terminated. Heat is applied in the area of the evaporator coils during the defrost cycle of operation for defrosting the coils. Since there is a natural tendency for such heat to rise by convection, the heat would eventually reach the interior of the display case. A heat trap mechanism is provided within the air conduit at a location subsequent to that of the evaporator coils along the flow path in order to prevent such flow of heat by convection during the defrost cycle of operation.

22 Claims, 2 Drawing Figures

GLASS DOOR MERCHANDISER WITH HEAT TRAP

BACKGROUND OF THE INVENTION

The present invention relates to a glass door merchandiser type of refrigerated display case. While reference is made herein to the use of glass doors since those are the types of doors most frequently utilized, other types of doors can be used within the scope of the present invention. In addition, the term refrigerated, in accordance with the present invention, is intended to incorporate both those cases maintained at a temperature either at or in excess of 32° F., such as frozen food cases. While the present invention can be utilized with both types of display cases, it is of particular advantage with glass door freezer cases.

In the operation of conventional refrigerated display cases having an opening in either the top or front wall, during the defrost operation a flow of air through the air conduit can be maintained and possibly directed along a path for causing the defrost air to flow outside, and away from the display case. Such an air flow pattern is especially utilized in the ambient air defrost refrigerated display cases. During the defrost operation of refrigerated display cases which do not have any doors covering the access opening and utilize either an electric or gas defrost system, the hot air created in the air conduit containing the evaporator coils can be allowed to flow along the air conduit and out of the display case since the access opening is not blocked. In refrigerated display cases having glass doors, or any other type of doors, allowing for such an air flow of the hot air from inside of the conduit to pass along the air conduit can lead to undesirable and improper operation of the display case.

In the glass door refrigerated display cases, any air leaving the openings to the air conduit is not free to flow out of the case due to the presence of the door and hence would flow into the display section of the display case. During the defrost operation, the defrosting of the frost buildup on the evaporator coils will release moisture to the air flowing through the air conduit. The moisture in the defrost air if allowed to reach the display section of the display case will collect on the products stored within the display case. In addition, the warm air will raise the temperature of the products in the display case. Such accumulation of frost on the refrigerated products and increase in the temperature of such products is detrimental both to the storage of the products and the appearance of such products. This problem is especially predominant in freezer display cases where the frozen products are more susceptible to damage.

Several exemplary embodiments of glass door refrigerated display merchandisers are shown in U.S. Pat. Nos. 3,063,254 to Dickinson, et al., 3,091,942 to Dickinson, et al. and U.S. Pat. No. Re. 26,587 to Thompson. None of these patents, however, provide any mechanism for preventing the heat created during the defrost operation from passing through the conduit and entering the display section of the merchandiser.

SUMMARY OF THE INVENTION

An object of the present invention is to provide an improved refrigerated glass door merchandiser.

Another object of the present invention is to provide a glass door merchandiser in which heat created during a defrost cycle of operation is prevented from flowing into the display section of the merchandiser.

A further object of the present invention is to provide a glass door merchandiser in which the moisture released during a defrost operation is prevented from flowing by air convection into the interior display section of the merchandiser.

Still another object of the present invention is to provide a glass door merchandiser in which the air flow during the defrost operation is terminated and heat created by the defrosting operation is trapped within the portion of the air conduit containing the evaporator coils.

A still further object of the present invention is to provide a refrigerated display case having an access opening with a movable door covering such opening where during the defrost operation heat created in the area of the evaporator coils is prevented from flowing into the display section of the display case.

These objectives of the present invention are achieved by the provision of a refrigerated display case in accordance with the present invention. The display case is formed by a cabinet having an interior display section and an access opening in one of its walls, either the front or top wall. At least one door, generally a glass door, covers the access opening with such door being movable for enabling access through the access opening to products within the display section of the display case. An air conduit surrounds the cabinet and has inlet and outlet openings so as to create an air curtain across the access opening during a refrigeration cycle of operation. A set of fans are arranged within the air conduit for circulating air through the conduit during the refrigeration cycle of operation. During refrigeration, as the air is circulated through the air conduit, the air is refrigerated by a set of evaporator coils arranged within the conduit.

During the operation of the above-described refrigerated display case, the case is periodically defrosted in order to remove the frost buildup on the evaporator coils. During the defrost cycle of operation, the air flow through the air conduit is temporarily terminated and the operation of the evaporator coils is likewise terminated. Heat is then applied to the evaporator coils for melting any frost buildup on the coils. Such heat can be applied either by electric or gas defrost systems which are well known within the art. The melted frost drains out of the case through openings in the bottom of the air conduit. As the air defrost cycle of operation occurs, the air surrounding the evaporator coils is heated. In order to avoid drawbacks of the prior art glass door merchandisers, as previously discussed above, it is desirable to prevent this hot air from circulating through the air conduit so as to pass into the display section of the merchandiser. Although the air circulating fans are turned off, such heat would still have a tendency to circulate through the conduit by convection. This is especially true in the open front glass door merchandisers where the evaporator coils are provided in the vertically extending rear portion of the air conduit. In order to prevent such heat flow by convection, a heat trap mechanism is arranged within the air conduit. The heat trap mechanism prevents the flow of heat during the defrost cycle of operation and effectively substantially isolates the upper portion of the conduit which contains cold air and the lower portion of the conduit which contains the hot air generated by the defrost operation.

The number of fans arranged within the display case depends on the overall length and size of the case and the size of the fans. Typically, in an 8 foot long case two fans would be provided for circulating the air while in a 12 foot long case three fans would be provided. In addition, the number of evaporator coils can vary as is well known in the art. Either a single evaporator or a plurality of coils can be utilized with all the coils being arranged within the air conduit. The heat trap mechanism is preferably arranged within the air conduit for preventing the heat from defrosting all of the evaporator coils from passing through the conduit and entering the display section of the merchandiser.

During the defrost operation, the heat trap mechanism creates a substantial balance of pressure between the cold air on the side of the heat trap opposite the evaporator coils and the hot air on the side of the heat trap where the evaporator coils are located. Such balance in the pressure creates a substantial stagnation of any flow of heat by convection during defrost. The heat trap mechanism includes a labyrinth structure that is formed within the air conduit. The labyrinth structure separates the air conduit into the top and bottom portions with the evaporator coils being located in the bottom portion. The labyrinth structure allows for the free flow of air from the bottom portion to the top portion during a refrigeration cycle of operation while it substantially prevents any flow of hot air during a defrost cycle of operation. The labyrinth structure includes upper and lower interleaved L-shaped members which face in opposing directions.

During the defrost operation some melting of any frost buildup in the upper portion of the air conduit will occur. In order to allow such melted frost to drain from the upper portion, an opening can be provided in the bottom L-shaped member of the labyrinth structure. This opening allows the liquid to drain into the bottom portion of the conduit and from there through the drain opening in the refrigerated display case.

The defrost operation is terminated when the temperature at the evaporator coils reaches approximately 50° and has remained at such temperature for a long enough period of time for adequately defrosting the coils. The length of time would depend upon the size of the display case and the number of coils to be defrosted. At the conclusion of the defrost cycle of operation, the evaporator coils are turned back into operation. Prior to commencing the air flow again, however, the temperature in the bottom portion of the conduit is allowed to reach 20° F. In this manner, any moisture still remaining in the area of the evaporator coils will refreeze and hence not be picked up by the air flow when it is reestablished.

DESCRIPTION OF THE PREFERRRED EMBODIMENT

Figure 1:
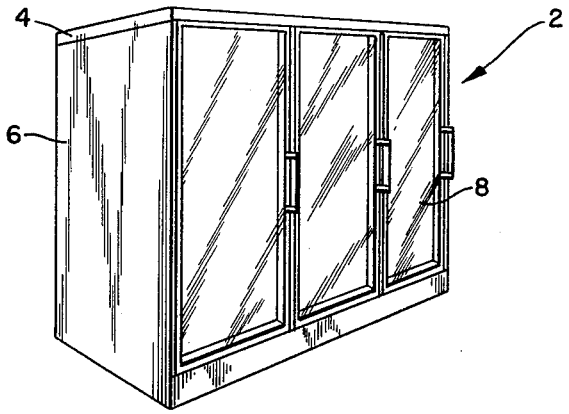
FIG. 1 is a front perspective view of a glass door merchandiser in accordance with the present invention.
Figure 2:
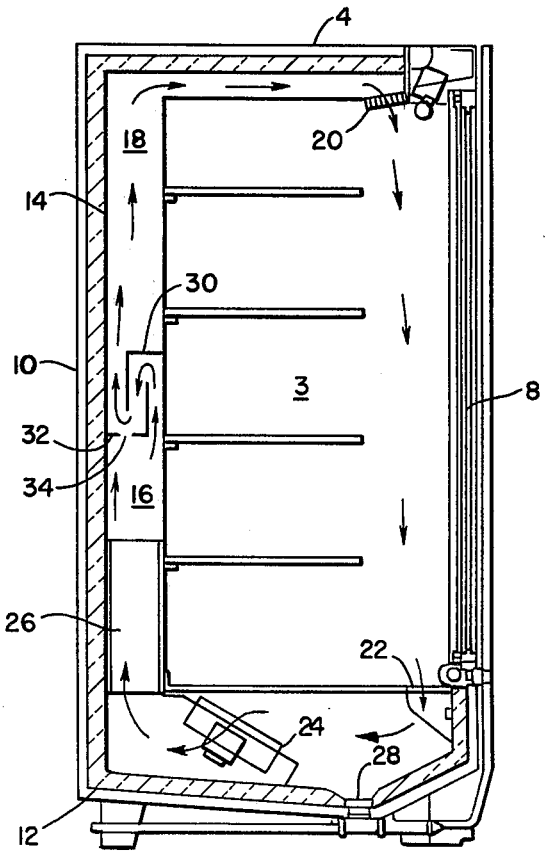
FIG. 2 is a side elevational partial sectional view of a glass door merchandiser in accordance with the present invention during a refrigeration cycle of operation.

A glass door merchandiser 2, such as shown in FIG. 1, has a top wall 4, side walls 6 and a front access opening covered by a plurality of glass doors 8. Glass doors 8 can be either hinged so as to swing outwardly from the case or can be vertically slidable along the case for enabling access to the display section 3 of display merchandiser 2. As shown in FIG. 2, display merchandiser 2 has a rear wall 10 and a bottom wall 12.

An air conduit 14 extends around display merchandiser 2 so as to enable the circulation of a continuous air band of air around the interior of the case. Air conduit 14 has a bottom portion 16 and a top portion 18, as will be discussed further below. The air circulated through conduit 14 is emitted from the conduit through an outlet opening 20 so as to be directed across the access opening immediately inside of glass door 8. The air stream across the access opening is received back into air conduit 14 through an inlet opening 22. Air is circulated through conduit 14 by a plurality of fans such as fan 24. During the refrigeration cycle of operation, the circulated air is refrigerated by an evaporator coil 26. The air flow pattern during a refrigeration cycle of operation is represented by the arrows in FIG. 2.

As the air flows through the conduit it passes from bottom portion 16 of the conduit to top portion 18 of the conduit through a labyrinth structure formed by two interleaved L-shaped members 30 and 32. The L-shaped members face in opposing direction so as to provide a labyrinth path for the air flow.

During the defrost cycle of operation of the display case, fan 24 is temporarily turned off. Similarly, operation of evaporator coil 26 is temporarily turned off during defrost. At this time heat is applied in the area of evaporator coil 26 either by an electric heat source arranged within the air conduit or by passing hot gas through the evaporator coil; both types of defrost systems are known in the art. As the frost on the evaporator coil melts, the liquid drains out of the cabinet through a drain 28.

During the defrost cycle of operation, the heat created within bottom portion 16 of conduit 14 would normally rise by convection into top portion 18 of the conduit. Such heat would then pass into interior display section 3 of the display merchandiser. In order to prevent such passage of heat, the labyrinth structure formed by L-shaped member 30 and 32 is provided. The labyrinth structure is constructed such that the cold air pressure in top portion 18 of the conduit substantially balances the pressure of the hot air in lower portion 16 of the conduit so as to cause a stagnation of any air flow through the conduit. This balancing occurs due to the labyrinth arrangement and the extent of overlap between the two L-shaped members.

In accordance with a preferred embodiment of the present invention, in a display case 81½ inches high, it was found that the total length of the labyrinth structure should be approximately 7 inches. Each of the L-shaped members 30 and 32 has a vertically extending portion that extends a distance of 5½ inches. The distance between the L-shaped members and each L-shaped member and the adjacent side wall is 1½ inches.

While the majority of the heat is retained in bottom portion 16 of conduit 14, some defrosting of any frost buildup in top portion 18 of the conduit will occur during the defrost cycle of operation. In order to allow any melted frost to drain out of top portion 18 of the conduit, an opening 34 can be provided in lower L-shaped member 32. Such liquid then can drain through lower portion 16 of the conduit into the bottom of the conduit and out of drain 28.

The present invention may be embodied in other specific forms without departing from the spirit or essential characteristics thereof. The present embodiment is presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A refrigerated display case having a display section therein comprising:

a cabinet having top, bottom rear and side walls and an access opening in one of said walls;

at least one door covering said access opening, said door being movable for enabling access through said access opening to products within said display section of said display case;

an air conduit extending around said cabinet and having an outlet opening at one end of said access opening of said cabinet and an inlet opening at the opposing end of said access opening of said cabinet, said outlet opening and said inlet opening being arranged in alignment so that air leaving said outlet opening during a refrigeration cycle of operation will be directed towards and received by said inlet opening for forming an air curtain across said access opening along the path inside of said door;

an air band establishing means for establishing a flow of refrigerated air through said air conduit during a refrigeration cycle of operation;

refrigeration means arranged in said air conduit for refrigerating air flowing through said air conduit during a refrigeration cycle of operation, said refrigeration means being arranged at a location lying below the level of said outlet opening of said air conduit;

defrost means for defrosting said display case when said display case is operated in a defrost cycle of operation, said defrost means terminating the flow of air through said air conduit, terminating the operation of said refrigeration means and causing the application of heat to said refrigeration means during a defrost cycle of operation; and, heat trap means arranged within said air conduit subsequent to the location of said refrigeration means along the air flow path so that the portion of said air conduit downstream of said heat trap is substantially thermodynamically isolated from the portion of said air conduit upstream of said heat trap for preventing the flow of heat by convection to said display section of said display case during a defrost cycle of operation.

2. A refrigerated display case according to claim 1 wherein said access opening is in said front wall of said display case and said outlet opening and inlet opening are aligned along a substantially vertical path with said outlet opening being near said top wall of said cabinet so that during a refrigeration cycle of operation a curtain of refrigerated air is formed so as to extend in a substantially vertical direction flowing from top to bottom across said front opening in said cabinet.

3. A refrigerated display case according to claim 2 wherein said door is a glass door.

4. A refrigerated display case according to claim 2 wherein said refrigeration means includes a set of evaporator coils, said evaporator coils being located in a portion of said air conduit adjacent to said rear wall of said cabinet.

5. A refrigerated display case according to claim 1, 2, 3 or 4 wherein said heat trap means substantially prevents the flow of any hot air during a defrost cycle of operation towards said display section of said display case.

6. A refrigerated display case according to claim 5 wherein said display case is a freezer case.

7. A refrigerated display case according to claim 5 wherein said heat trap means creates substantial balance of pressure between cold air on the side of said heat trap means opposite said refrigeration means and hot air on the side of said heat trap means of said refrigeration means during a defrost cycle of operation so as to substantially cause stagnation of any flow of heat by convection.

8. A refrigerated display case according to claim 7 wherein said heat trap means includes a labyrinth structure formed within said air conduit and separating said air conduit into a top portion and a bottom portion, said labyrinth structure enabling free flow of air from said bottom portion to said top portion during a refrigeration cycle of operation while substantially preventing any flow of hot air during a defrost cycle of operation from said bottom portion of said air conduit into said top portion of said air conduit.

9. A refrigerated display case according to claim 8 wherein said labyrinth structure is formed by upper and lower interleaved L-shaped members facing in opposing directions.

10. A refrigerated display case according to claim 9 wherein said lower L-shaped member of said labyrinth structure has an opening therein for allowing condensation from said upper portion of said air conduit that contains cold air during a defrost cycle of operation to drain into said lower portion of said air conduit that contains hot air during a defrost cycle of operation.

11. A refrigerated display case according to claim 1, 2, 3 or 4 wherein said defrost means terminates a defrost cycle of operation when the temperature at said refrigeration means reaches approximately 50°.

12. A refrigerated display case according to claim 11 wherein said defrost means turns said refrigeration means back into operation at the conclusion of a defrost cycle and when said refrigeration means reaches 20° F. reactivates said air band establishing means.

13. A refrigerated display case having a display section therein comprising:

a cabinet having top, bottom, rear and side walls and an access opening in one of said walls;

at least one door covering said access opening, said door being movable for enabling access through said access opening to products within said display section of said display case;

an air conduit extending around said cabinet and having an outlet opening at one end of said access opening of said cabinet and an inlet opening at the opposing end of said access opening of said cabinet, said outlet opening and said inlet opening being arranged in alignment so that air leaving said outlet opening during a refrigeration cycle of operation will be directed towards and received by said inlet opening for forming an air curtain across said access opening along the path inside of said door;

an air band establishing means for establishing a flow of refrigerated air through said air conduit during a refrigeration cycle of operation;

refrigeration means arranged in said air conduit for refrigerating air flowing through said air conduit during a refrigeration cycle of operation, said refrigeration means being arranged at a location lying below the level of said outlet opening of said air conduit;

defrost means for defrosting said display case when said display case is operated in a defrost cycle of operation, said defrost means terminating the flow of air through said air conduit, terminating the operation of said refrigeration means and causing the application of heat to said refrigeration means during a defrost cycle of operation; and, heat trap means arranged within said air conduit subsequent to the location of said refrigeration means along the air flow path for creating a substantial balance of pressure between cold air on the side of said heat trap means opposite said refrigeration means and hot air on the side of said heat trap means of said refrigeration means during a defrost cycle of operation so as to substantially cause stagnation of any flow of heat past said heat trap means.

14. A refrigerated display case according to claim 13 wherein said access opening is in said front wall of said display case and said outlet opening and inlet opening are aligned along a substantially vertical path with said outlet opening being near said top wall of said cabinet so that during a refrigeration cycle of operation a curtain of refrigerated air is formed so as to extend in a substantially vertical direction flowing from top to bottom across said front opening in said cabinet.

15. A refrigerated display case according to claim 14 wherein said door is a glass door.

16. A refrigerated display case according to claim 15 wherein said heat trap means substantially prevents the flow of any hot air during a defrost cycle of operation towards said display section of said display case.

17. A refrigerated display case according to claim 15 wherein said display case is a freezer case.

18. A refrigerated display case according to claim 17 wherein said heat trap means includes a labyrinth structure formed within said air conduit and separating said air conduit into a top portion and a bottom portion, said labyrinth structure enabling free flow of air from said botton portion to said top portion during a refrigeration cycle of operation while substantially preventing any flow of hot air during a defrost cycle of operation from said bottom portion of said air conduit into said top portion of said air conduit.

19. A refrigerated display case according to claim 18 wherein said labyrinth structure is formed by upper and lower interleaved L-shaped members facing in opposing directions.

20. A refrigerated display case according to claim 19 wherein said lower L-shaped member of said labyrinth structure has an opening therein for allowing condensation from said upper portion of said air conduit that contains cold air during a defrost cycle of operation to drain into said lower portion of said air conduit that contains hot air during a defrost cycle of operation.

21. A refrigerated display case according to claim 13 or 20 wherein said defrost means terminates a defrost cycle of operation when the temperature at said refrigeration means reaches approximately 50°.

22. A refrigerated display case according to claim 21 wherein said defrost means turns said refrigeration means back into operation at the conclusion of a defrost cycle and when said refrigeration means reaches 20° F. reactivates said air band establishing means.

* * * * *